US005104484A

United States Patent [19]

Nakanishi et al.

[11] Patent Number: 5,104,484

[45] Date of Patent: Apr. 14, 1992

[54] METHOD FOR MANUFACTURING SUBSTRATES FOR PS PLATES

[75] Inventors: Haruo Nakanishi; Akira Nishioka; Yoshikatsu Kagawa; Nobuyoshi Kaneko, all of Shizuoka, Japan

[73] Assignee: Fuji Photo Film Co., Ltd., Minami-ashigara, Japan

[21] Appl. No.: 581,922

[22] Filed: Sep. 13, 1990

[30] Foreign Application Priority Data

Sep. 18, 1989 [JP] Japan ..... 1-241581

[51] Int. Cl.[5] ..... B44C 1/22; C23F 1/00

[52] U.S. Cl. ..... 156/651; 101/453; 101/463.1; 156/665; 156/905; 204/129.35

[58] Field of Search ..... 156/645, 651, 654, 659.1, 156/665, 905; 430/165, 166, 168, 169, 276, 278; 204/6, 33, 38.3, 129.35, 129.65; 101/453, 456, 459, 463.1; 252/79.2, 79.3, 79.4, 79.5

[56] References Cited

U.S. PATENT DOCUMENTS 3,891,516 6/1975 Chu ..... 204/33
4,714,528 12/1987 Takeuchi et al. ..... 204/129.46 X
4,824,757 4/1989 Aono et al. ..... 430/169
4,872,946 10/1989 Uesugi et al. ..... 156/665 X
4,909,894 3/1990 Uesugi et al. ..... 156/665 X

FOREIGN PATENT DOCUMENTS 60-8091 1/1985 Japan .

*Primary Examiner*—William A. Powell
*Attorney, Agent, or Firm*—Burns, Doane, Swecker & Mathis

[57] ABSTRACT

A method for manufacturing a substrate for presensitized plates for use in making lithographic printing plates comprises the steps of electrolytically surface-roughening an aluminum plate or an aluminum alloy plate in a nitric acid-containing electrolyte and then etching the surface with an alkali or an acid to thus form irregularity in the order of not more than 0.1 μm within pits formed on the surface during the electrolytic surface roughening treatment. The method makes it possible to provide a lithographic printing plate stably and simultaneously having excellent printing durability and good resistance to background contamination of non-image areas.

20 Claims, No Drawings

METHOD FOR MANUFACTURING SUBSTRATES FOR PS PLATES

BACKGROUND OF THE INVENTION

The present invention relates to a method for manufacturing a substrate for presensitized plates for use in making lithographic printing plates.

Up to now, there have widely been employed aluminum plates as substrates for making presensitized plates for use in making lithographic printing plates (hereinafter referred to as "PS plates") and it has been known that the substrates and hence the aluminum plates for PS plates have been subjected to a surface-roughening treatment, i.e., so-called surface graining for the purposes of improving the adhesion between the substrate and the light-sensitive layer and of imparting water retention characteristics to the non-image areas of the resulting lithographic printing plate.

As specific means for such surface graining, there have been known, for instance, mechanical graining methods such as sand blasting, ball graining, wire graining, brush graining in which a nylon brush and an abrasive/water slurry are used, and honing-graining in which an abrasive/water slurry is blown on the surface to be treated at a high pressure; and chemical graining methods such as those in which the surface to be treated is roughened by treating it with an etching agent such as an alkali, an acid or a mixture thereof. In addition to the foregoing methods, there have also been known, for instance, an electrochemical graining method as disclosed in Japanese Patent Unexamined Publication (hereunder referred to as "J.P. KOKAI") Nos. Sho 54-146234 and Sho 48-28123; a method comprising a combination of mechanical graining and electrochemical graining methods as disclosed in J.P. KOKAI Nos. Sho 54-123204 and Sho 54-63902; and a method comprising a combination of a mechanical graining method with a chemical graining method which comprises chemically etching the surface with a saturated aqueous solution of an aluminum salt of a mineral acid as disclosed in J.P. KOKAI No. Sho 56-55291 (U.S. Pat. No. 4,242,417).

Among these surface-roughening methods, electrolytic surface-roughening treatments are favorably adopted in the present invention because the control of the conditions of the roughened surface is easy and a finely roughened surface can be obtained.

The roughened aluminum surface as such is very soft and hence easily worn out. For this reason, the surface-roughened aluminum is anodized to form an oxidized layer and a light-sensitive layer is applied onto the oxidized layer thus formed. The surface of the aluminum plate thus treated is very hard, excellent in wear resistance and shows good hydrophilicity and has good water retention characteristics and strong adhesion to the light-sensitive layer.

However, if the electrolytically surface-roughened aluminum plate is anodized immediately after the electrolytic graining, the resulting anodized layer is blackened since smut formed during the electrolytic graining easily adheres to the electrolytically roughened surface. This substantially impairs the appearance thereof, leads to the occurrence of scatter and reduction of the sensitivity of the light-sensitive layer applied thereto and further impairs the plate-examining characteristics after the development of an exposed PS plate. In addition, the printing durability of the resulting lithographic printing plate is also lowered because of the formation of a layer having poor adhesion to the light-sensitive layer on the aluminum plate.

As a method which can solve such a problem to some extent, J.P. KOKAI No. Sho 53-12739 discloses a method comprising desmutting the aluminum plate after the electrolytic surface-graining. This method makes it possible to remove smut formed during the electrolytic surface-graining, but it takes a long time period for removing unevenness of the surface due to the electrolytic surface graining treatment thereof. Moreover, J.P. KOKAI No. Sho 48-28123 discloses a method which comprises electrolytically surface-roughening an aluminum plate in hydrochloric acid as an electrolyte and then etching the plate with an alkali. In this alkali-etching treatment, the removal of the smut formed as well as the etching proceed at a high speed. Thus, if the surface which is electrolytically surface-roughened in hydrochloric acid is subjected to this alkali etching treatment, the structure of the grained surface becomes excessively smooth. As a result, the adhesion between the light-sensitive layer and the treated surface is greatly lowered and hence the printing durability of the resulting lithographic printing plate is also lowered. On the other hand, the non-image areas of the resulting printing plate are very excellent in resistance to background contamination.

In addition, J.P. KOKAI No. Sho 56-139700 disclosed a method which comprises electrolytically graining the surface of a substrate (an aluminum plate) for printing plates in a dilute aqueous acid solution or an aqueous salt solution, etching the surface with an alkaline aqueous solution in an amount ranging from 0.4 to 3.0 $g/m^2$ and then anodizing the surface. The inventors of this invention have conducted detailed investigation of this method and as a result they have found that the printing durability is inevitably reduced if the surface is etched in such an amount of not less than 0.4 $g/m^2$.

Further, J.P. KOKAI No. Sho 56-47041 (U.S. Pat. No. 4,824,757) discloses a method comprising the steps of electrolytically roughening the surface of a substrate (an aluminum plate) in a nitric acid-containing electrolyte, then etching the substrate with an alkali, anodizing the substrate and applying a light-sensitive layer comprising an o-quinonediazide and J.P. KOKAI No. Sho 60-8091discloses, for instance, a method which comprises the steps of electrolytically surface-roughening a substrate (an aluminum plate) in an electrolyte containing nitric acid or a salt thereof, etching the substrate with an alkali or an acid so that the amount of the aluminum removed is equal to 0.1 to 0.5 $g/m^2$, then anodizing the substrate and applying a negative-working light-sensitive layer.

The inventors of this invention have also conducted detailed investigation of these improved methods and as a result they have found that a severe scatter of the printing durability of the resulting lithographic printing plates is observed and thus only lithographic printing plates showing unstable quality are obtained according to these improved methods.

SUMMARY OF THE INVENTION

Accordingly, a principal object of the present invention is to provide a method for manufacturing a substrate which makes it possible to form PS plates capable of providing lithographic printing plates stably and simultaneously having excellent printing durability and good resistance to background contamination of non-image areas.

The foregoing object of the present invention can be achieved by providing a method for manufacturing a substrate for PS plates which comprises the steps of electrolytically surface-roughening an aluminum plate or an aluminum alloy plate in a nitric acid-containing electrolyte and then etching the surface with an alkali or an acid to thus form irregularly in the order of not more than 0.1 μm within pits formed during the electrolytic surface-roughening treatment.

DETAILED EXPLANATION OF THE INVENTION

The present invention will, in order, be explained in more detail below.

Specific examples of aluminum or aluminum alloy plates (hereinafter referred to as simply "aluminum plates") used in the present invention are a variety of aluminum plates such as JIS A1050, JIS A1100, JIS A3003, JIS A3103 and JIS A5005. Among these, it has been known that the aluminum plate JIS A1050 is excellent in electrolytic surface-roughening properties, in other words can easily provide finely grained surface conditions through the electrolytic surface-roughening treatment, but has a relatively low strength as a substrate, while the aluminum plates JIS A1100, JIS A3003 and JIS A5005 have relatively high strength as substrates and good handling properties, but are inferior in the electrolytic surface-roughening properties to the aluminum plate JIS A1050. Under such circumstances, the use of the aluminum plate JIS A3103 which simultaneously satisfies the requirements of both strength and electrolytic surface-roughening properties is more preferably adopted as the aluminum plate for PS plates.

The foregoing aluminum plates may optionally be pretreated prior to the electrolytic surface-roughening treatment, if necessary, for the purpose of removing rolling oil on the surface thereof or of exposing the clean surface thereof. There have widely been employed, for instance, solvents such as trichloroethylene, surfactants and/or sodium silicate for removing the rolling oil on the surface; and alkali etching agents such as sodium hydroxide and potassium hydroxide for achieving the latter purpose.

In the subsequent electrolytic surface roughening treatment, there have been used alternating current power supply waves, inclusive of sinusoidal single-phase alternating current and sinusoidal three-phase alternating current as well as alternating waved current such as rectangular waved current and trapezoidal waved current. Among these, the rectangular waved alternating currents are preferably used because the working power can be reduced and any grained surface conditions may be obtained.

Moreover, a nitric acid-containing electrolyte is employed as an electrolyte for electrolytic surface-roughening. Any electrolytes known in the art as such nitric acid-containing ones may be used in the present invention. The concentration of nitric acid in the electrolyte suitably ranges from about 0.5 to 5% by weight. The nitric acid-containing electrolyte may further comprise, if necessary, corrosion inhibiting agents (or stabilizers) such as nitrates, monoamines, diamines, aldehydes, phosphoric acid, chromic acid, boric acid, ammonium salts, aluminum salts and carbonates.

In the present invention, there may be adopted a method which comprises passing, through an aluminum plate in a nitric acid-containing electrolyte, an alternating current at an electric voltage in which the anodic voltage is higher than the cathodic voltage so that the quantity of anode time electricity is higher than the quantity of cathode time electricity as disclosed in U.S. Pat. No. 4,087,341; or a method in which an apparatus for electrolytically surface-roughening is employed, the apparatus comprising a first circuit connected to a principal counter electrode against the aluminum plate, a second circuit for an auxiliary counter electrode connected, in parallel relation, to the first circuit and a diode or a mechanism serving as a diode for controlling the anode current passing through the principal counter electrode, which is fitted to the second circuit for the auxiliary counter electrode as disclosed in Japanese Patent Publication for Opposition Purpose (hereunder referred to as "J.P. KOKOKU") No. Sho 61-48596.

The electric voltage to be applied to the aluminum plate preferably ranges from about 1 V to about 50 V, more preferably 2 to 30 V; the current density preferably ranges from about 10 A/dm$^2$ to about 100 A/dm$^2$, more preferably 10 to 80 A/dm$^2$ and the quantity of electricity preferably ranges from about 100 coulomb/dm$^2$ to about 30,000 coulomb/dm$^2$, more preferably 100 to 18,000 coulomb/dm$^2$. In addition, the temperature of the electrolytic bath preferably ranges from about 10° C. to about 70° C., more preferably 20° to 60° C.

The surface thus electrolytically roughened is subsequently subjected to a light etching treatment.

The surface of the aluminum plate is dissolved with an aqueous solution of an acid or an alkali through the etching treatment. Examples of acids used in the etching treatment are sulfuric acid, persulfuric acid, hydrofluoric acid, nitric acid and hydrochloric acid; and examples of alkalis used in the etching are sodium hydroxide, potassium hydroxide, sodium tertiary phosphate, potassium tertiary phosphate, sodium aluminate, sodium silicate and sodium carbonate. Among these, the use of alkalis is preferred because the etching proceeds at a high rate.

The inventors of this invention have investigated in detail the correlation between the amount of the aluminum removed through the etching and the conditions of the etched surface and as a result have found that very fine irregularity within the pits formed during the electrolytic surface-roughening treatment (not more than 0.1 μm as determined in terms of a high resolution-electron microscope (FESEM)) is closely related to printing properties of the resulting lithographic printing plate.

In other words, a lithographic printing plate was prepared using a grained substrate having such fine irregular structures on the surface, fitted to a printing press and printing operations were performed to evaluate the printing properties of the printing plate and as a result it was found that the printing plate obtained from the substrate having fine irregularity within the pits formed on the surface during the electrolytic surface-graining treatment had non-image areas which hardly caused background contamination and excellent printing durability (or adhesion between the substrate and the light-sensitive layer applied thereto) compared with those for the printing plate obtained using substrates free of such irregularity within the pits.

Thus, the method of the present invention can provide a substrate for a PS plate and hence a lithographic printing plate whose image areas have good printing durability and whose non-image areas hardly cause background contamination.

In addition, it has also been found out that if the amount of aluminum removed through the etching of the surface thereof except for the smut generated during the electrolytic surface-graining (the smut can easily be removed through a chemical treatment using a 25% sulfuric acid solution) is less than 0.02 $g/m^2$, the resistance to background contamination of the non-image areas is insufficient, while if it exceeds 0.2 $g/m^2$, the adhesion of the substrate to the light-sensitive layer (image areas) is substantially reduced and hence the printing durability of the resulting lithographic printing plate is greatly impaired.

Therefore, it is desirable in the present invention that the amount of aluminum to be removed through the etching except for the amount of the smut be in the range of from 0.02 to 0.2 $g/m^2$, preferably 0.02 to 0.09 $g/m^2$.

The aluminum plate thus treated is desirably anodized to thus form an anodized layer on the surface thereof prior to the production of a PS plate for the purpose of improving the water retention, adhesion to the light-sensitive layer and the mechanical strength of the non-image areas. The anodic treatment can be performed in the usual manner. For instance, the anodic treatment can be performed mainly using a direct current in an aqueous solution or non-aqueous solution containing sulfuric acid, phosphoric acid, oxalic acid, chromic acid, amidesulfonic acid or mixture thereof, to which $Al^{3+}$ions may be added. Alternatively, an alternating current or a combination of a direct current and an alternating current may also be employed. The conditions for the anodization are preferably the concentration of the electrolyte ranging from 1 to 80% by weight; a temperature ranging from 5° to 70° C; a current density ranging from 0.5 to 60 $A/dm^2$ and the weight of the anodized layer formed ranging from 0.3 to 6 $g/m^2$.

The aluminum plate thus anodized may further be subjected to a treatment such as a hydrophilization by a method which comprises dipping it in an aqueous solution of an alkali metal silicate such as sodium silicate as disclosed in U.S. Pat. Nos. 2,714,066 and 3,181,461; application of an underlying layer such as a layer of a hydrophilic cellulose (such as carboxymethyl cellulose) containing a water-soluble metal salt (for instance, zinc acetate) as disclosed in U.S. Pat. No. 3,860,426; or a treatment with polyvinyl sulfonic acid as disclosed in U.S. Pat. No. 4,135,461. It is also possible to use an underlying layer comprising a polymeric compound composed of monomer units carrying a sulfonic acid group as disclosed in J.P. KOKAI No. Sho 59-101651 (U.S. Pat. No. 4,578,342) or that comprising a compound carrying $NH_4$ group•COOH group•$SO_3H$ group as disclosed in J.P. KOKAI No. Sho 60-149491 (U.S. Pat. No. 4,801,527).

A conventionally known light-sensitive layer is applied onto the substrate thus obtained for PS plates to thus give a PS plate and the lithographic printing plate obtained from the PS plate through a plate-making process shows excellent properties.

A PS plate can be prepared by applying a light-sensitive layer as will be listed below onto the substrate prepared by the method of the present invention.

[I] light-sensitive layer comprising an o-naphthoquinonediazidesulfonate of polyhydric polymeric compound and a novolak resin comprising a phenol•cresol mixture.

Polyhydric compounds having an average molecular weight ranging from 1,000 to 7,000 are used and are polycondensates of phenolic compounds having at least two hydroxyl groups on the benzene ring such as resorcinol and pyrogallol with aldehyde compounds such as formalin and benzaldehyde. In addition to these polycondensates, there may also be employed, for instance, phenol•formaldehyde resins, cresol•formaldehyde resins, p-tert-butylphenol•formaldehyde resins and xylene resins modified with phenol. Moreover, preferred novolak resins are those containing phenols having a relatively high molecular weight and examples thereof are phenol-m-cresol-formaldehyde novolak resins as disclosed in J.P. KOKAI No. Sho 55-57841; and those disclosed in J.P. KOKAI No. Sho 61-177450. The light-sensitive layer may further comprise compounds generating acids through irradiation with light such as o-naphthoquinonediazide-4-sulfonyl chloride, salts of p-diazodiphenyl-amine with inorganic anions, trihalomethyloxadiazole compounds and trihalomethyloxadiazole compounds having a benzofuran ring or the like for the purpose of forming a visible image immediately after exposure to light. The light-sensitive layer may also comprise a triphenyl methane dyes such as Victoria Pure Blue BOH, Crystal Violet and Oil Blue. The light-sensitive composition containing these components is applied onto the substrate in an amount ranging from 0.5 to 3.0 $g/m^2$ expressed in the amount of solid contents.

[II] light-sensitive layer comprising a diazo resin and a water-insoluble, lipophilic polymeric compound carrying hydroxyl groups:

As has been described above, the substrate is immersed in an aqueous alkali metal silicate solution as disclosed in U.S. Pat. No. 3,181,461 after it is anodized. It is preferred that a light-sensitive layer which comprises a $PF_6$, $BF_4$ or organic acid salt of a diazo resin and a water-insoluble and lipophilic polymeric compound carrying hydroxyl groups be applied onto the surface of the substrate thus treated. Examples of such organic acids include aromatic sulfonic acids such as triisopropylnaphthalenesulfonic acid, 4,4'-bisphenyldisulfonic acid, 2,5-dimethylbenzenesulfonic acid, 2-nitrobenzenesulfonic acid, 1-naphthol-5-sulfonic acid and p-toluenesulfonic acid; aromatic sulfonic acids having a hydroxyl group such as 2-hydroxy-4-methoxybenzophenone-5-sulfonic acid. In addition, diazo resins as disclosed in J.P. KOKAI Nos. Sho 59-78340, Sho 61-91654, Sho 63-262643 and Sho 64-90451 are also preferably added to the light-sensitive composition used in the present invention.

The polymeric compounds having hydroxyl groups are those having a weight average molecular weight ranging from 5,000 to 500,000 and examples thereof include those listed below:

(1) copolymers of N-(4-hydroxyphenyl)acrylamide, N-(4-hydroxyphenyl)methacrylamide, N-(4-hydroxynaphthyl)methacrylamide or the like with other monomers;
(2) copolymers of o-, m- or p-hydroxystyrene with other monomers;
(3) copolymers of o-, m- or p-hydroxyphenyl methacrylate or the like with other monomers.

Examples of the aforementioned other monomers are those listed below:

(i) $\alpha$, $\beta$-unsaturated carboxylic acids such as acrylic acid, methacrylic acid and maleic anhydride;

(ii) alkyl acrylates such as methyl acrylate and ethyl acrylate;
(iii) alkyl methacrylates such as methyl methacrylate and ethyl methacrylate;
(iv) acrylamides or methacrylamides such as acrylamide and methacrylamide;
(v) vinyl ethers such as ethyl vinyl ether and hydroxyethyl vinyl ether;
(vi) styrenes such as styrene and α-methyl styrene;
(vii) ketones such as methyl vinyl ketone;
(viii) olefins such as ethylene, propylene and isoprene;
(ix) N-vinyl pyrrolidone, N-vinyl carbazole, acrylonitrile and methacrylonitrile; or the like.

The monomers may be any monomer which can be copolymerized with the foregoing monomers carrying an aromatic hydroxyl group.

Preferred examples of oil-soluble dyes which are added to the light-sensitive layer are Victoria Pure Blue BOH, Crystal Violet, Victoria Blue, Methyl Violet and Oil Blue #603.

The light-sensitive layer can be formed by adding, to the foregoing components, a fluorine atom-containing surfactant, a non-ionic surfactant, a plasticizer (such as dibutyl phthalate, polyethylene glycol, dibutyl phthalate and trioctyl phosphate) and a known stabilizer (such as phosphoric acid, phosphorous acid and organic acids) and applying the resulting composition to the substrate in an amount ranging from 0.5 to 3.0 g/m$^2$ (weighed after drying).

[III] light-sensitive compositions comprising a polymeric compound carrying carboxylic acid residues or carboxylic acid anhydride residues, an addition-polymerizable unsaturated compound and a photopolymerization initiator:

When a photopolymerizable light-sensitive composition is used for forming a light-sensitive layer, preferably used are those disclosed in J.P. KOKAI Nos. Sho 59-46643, Sho 62-11851 and Sho 60-144949. In particular, the substrate is preferably subjected to an anodization treatment with phosphoric acid or a mixed acid comprising phosphoric acid and sulfuric acid.

The light-sensitive layer can be formed by applying a photopolymerizable light-sensitive composition which comprises a polymeric compound carrying carboxylic acid residues or carboxylic acid anhydride residues, an addition-polymerizable unsaturated compound and a photopolymerization initiator onto the surface of a substrate which has been subjected to an anodic treatment in a phosphoric acid bath and then a silicate treatment or may be formed by the method as disclosed in J.P. KOKAI No. Sho 61-100497.

The polymers carrying carboxylic acid residues or carboxylic acid anhydride residues favorable for the foregoing purpose can be selected from those having structural repeating units selected from the group consisting of units represented by the following general formulae (A) to (D):

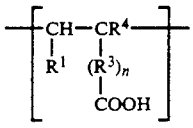

(A)

-continued

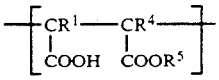

(B)

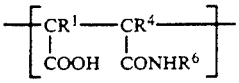

(C)

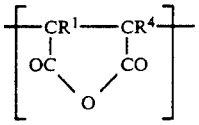

(D)

In the foregoing general formulae, $R^1$ and $R^4$ each represents a hydrogen atom or an alkyl group; $R^3$ represents a phenylene group or an alkylene group optionally having a hydroxyl group; $R^5$ represents a hydrogen atom or a substituted or unsubstituted alkyl group; $R^6$ represents a substituted or unsubstituted alkyl, aryl or cycloalkyl group; and n is 0 or 1.

More specifically, examples of structural units are those derived from acrylic acid, methacrylic acid, crotonic acid and vinyl benzoic acid for the repeating unit (A); those derived from maleic acid, monohydroxyalkyl maleate and monocyclohexyl maleate for the structural unit (B); those derived from maleic acid monoalkylamide and maleic acid monohydroxyalkylamide for the structural unit (C); and those derived from maleic anhydride and itaconic acid anhydride for the structural unit (D). The polymers used in the invention in general have an average molecular weight ranging from 1,000 to 100,000.

The addition polymerizable unsaturated compounds used in the invention are monomers carrying an ethylenically unsaturated double bond which causes addition polymerization so as to form a three-dimensional network and to thus make the resulting polymer insoluble when the photopolymerizable light-sensitive resin composition containing the same is exposed to actinic rays. Specific examples thereof are unsaturated carboxylic acids, esters of unsaturated carboxylic acids and aliphatic polyhydroxy compounds and esters of unsaturated carboxylic acids and aromatic polyhydroxy compounds.

Examples of the photopolymerization initiators used in the invention are benzoin, benzoin alkyl ether, benzophenone, anthraquinone and Michler's ketones which may be used alone or in combination and the light-sensitive composition containing the foregoing ingredients is applied onto the surface of a substrate in an amount ranging from 0.5 to 3.0 g/m$^2$ (weighed after drying).

The substrate of the present invention may be used as that for PS plates in which an electrophotographic light-sensitive material is employed, such as those disclosed in J.P. KOKAI No. Sho 60-107042.

If such a light-sensitive layer is applied onto the surface of the substrate produced by the method of this invention and the resulting PS plate is subjected to a plate-making process, a lithographic printing plate can be obtained, the printing plate showing excellent storage stability and quality of the visible images, in particular having excellent stability under severe conditions such as high temperature and high humidity.

In addition, the surface of the aluminum substrate exposed or non-image areas of the printing plates thus obtained are not contaminated with a printing ink, even if the exposed surface of the aluminum substrate becomes dirty with an ink, the contamination can easily and quickly be removed because of its excellent hydrophilicity and the surface of the aluminum substrate can provide good adhesion to the light-sensitive layer. In other words, the lithographic printing plates formed using the aluminum substrates of the present invention show excellent printing durability and the non-image areas thereof hardly cause background contamination.

The present invention will hereinafter explained in more detail with reference to the following non-limitative working Examples and the effects practically attained by the present invention will also be discussed in detail in comparison with the following Camparative Examples. In the following Examples and Comparative Examples, the term "%" means "% by weight" unless otherwise specified.

EXAMPLES 1 to 4

An aluminum plate (JIS A3103 aluminum plate) having a thickness of 0.30 mm was cleaned by dipping in a 10% aqueous sodium hydroxide solution maintained at 50° C. for 20 seconds to perform degreasing and then subjecting it to etching, washed with water, then neutralized with a 25% aqueous sulfuric acid solution for 30 seconds and washed with water.

Thereafter, the aluminum plate was electrolytically surface-roughened at a current density of 30 A/dm$^2$ in an electrolyte, i.e., a 1% nitric acid aqueous solution (containing 0.5% aluminum ions), using a rectangular waved alternating current having a frequency of 60 Hz so that the quantity of anode time electricity was 300 coulomb/dm$^2$ to thus give an aluminum substrate (I).

Then the aluminum substrate was treated with a 5% aqueous solution of sodium hydroxide (containing 1.5% of aluminum ions) at 35° ° C. for 7 seconds. The amount of aluminum dissolved out except for that of smut generated during the electrolytic surface-roughening treatment was 0.07 g/m$^2$. The amount of the smut was determined by dipping the aluminum substrate (I) in a 25% sulfuric acid solution maintained at 60° C. for 50 seconds to dissolve only the smut according to a gravimetric analysis. At this stage, the grained surface of the aluminum substrate was observed with a field emission type high resolution electron microscope (FE-SEM) and it was confirmed that very fine irregularity of the order of not more than 0.1 μm was formed within pits formed during the electrolytic surface-graining treatment.

After washing with water, the aluminum substrate was neutralized with a 25% aqueous sulfuric acid solution (containing 5% aluminum ions) for 20 seconds, washed with water and then anodized at a current density of 2 A/dm$^2$ for 3 minutes in a 15% aqueous sulfuric acid solution.

Subsequently, the aluminum substrate was dipped in a 2.5% aqueous sodium silicate solution, washed with water and dried to give a substrate (A-1) for PS plates.

A light-sensitive solution having the following formulation was applied onto the surface of the substrate thus obtained and dried to form a light-sensitive layer thereon. The amount of the light-sensitive solution weighed after drying was 2.0 g/m$^2$.

Light-Sensitive Solution

| Component | Amount (g) |
|---|---|
| N-(4-hydroxyphenyl)methacrylamide/ 2-hydroxymethacrylate/acrylonitrile/ methyl methacrylate/methacrylic acid copolymer (molar ratio = 10/20/25/35/10; average molecular weight = 60,000) | 5.0 |
| $PF_6$ Salt of a condensate of 4-diazodiphenylamine and formaldehyde | 0.5 |
| Phosphorous acid | 0.05 |
| Victoria Pure Blue BOH | 0.1 |
| Water | 5.0 |
| 1-Methoxy-2-propanol | 45.0 |
| Methyl ethyl ketone | 50.0 |

The PS plate thus prepared was exposed to light from a 3 KW metal halide lamp at a distance of 70 cm through a negative film carrying images for 45 seconds, developed with a developer having the following formulation and then gummed up to give a lithographic printing plate.

Developer

| Component | Amount (g) |
|---|---|
| Benzyl alcohol | 450 |
| Triethanolamine | 150 |
| Monoethanolamine | 10 |
| Sodium t-butylnaphthalenesulfonate | 150 |
| Sodium sulfite | 30 |
| Deionized water | 8420 |

The resulting lithographic printing plate was fitted to a printing press and the printing operations were performed. The results obtained are listed in the following Table I.

The same procedures as those used above were repeated except that the aluminum substrate (I) was treated with an aqueous sodium hydroxide solution while changing the temperature within the range of from 20° to 50° C. to thus give lithographic printing plates (A-2), (A-3) and (A-4). The amount of aluminum removed at this stage and the printing properties of the resulting lithographic printing plates are likewise summarized in Table I.

COMPARATIVE EXAMPLE 1

The aluminum substrate (I) obtained in Example 1 was treated with a 5% aqueous solution of sodium hydroxide (containing 1.5% of aluminum ions) at 50° C. for 7 seconds. The amount of aluminum dissolved out under these conditions was 0.25 g/m$^2$. The electrolytically grained surface of the aluminum substrate thus obtained was observed with a high resolution electron microscope (FE-SEM) and it was found that there was no fine irregularity within pits generated through the electrolytic surface-roughening treatment and that the inner surface of the pits was smooth.

Then the same procedures used in Example 1 were repeated to give a substrate (B) for PS plates.

The same procedures, from the formation of a light-sensitive layer via the preparation of a printing plate till the printing operations, used in Example 1 were repeated. The results thus obtained are listed in Table I.

COMPARATIVE EXAMPLE 2

The aluminum substrate (I) obtained in Example 1 was treated with a 5% aqueous solution of sodium hydroxide (containing 1.5% of aluminum ions) at 20° C. for 7 seconds. The amount of aluminum dissolved out under these conditions was 0.01 g/m$^2$. The electrolytically grained surface of the aluminum substrate thus obtained was observed with a high resolution electron microscope (FE-SEM) and it was found that there was no fine irregularity within pits generated through the electrolytic surface-roughening treatment and that large number of sharp projections like thorns remained around the periphery of the pits.

Thereafter, the same procedures used in Example 1 were repeated to give a substrate for PS plates (C).

The same procedures, from the formation of a light-sensitive layer via the preparation of a printing plate till the printing operations, used in Example 1 were repeated. The results thus obtained are listed in Table I.

TABLE I

| | Ex. No. | | | | | |
|---|---|---|---|---|---|---|
| | 1 | 2 | 3 | 4 | 1* | 2* |
| Substrate | A-1 | A-2 | A-3 | A-4 | (B) | (C) |
| Amount of Al Removed[1)] | 0.07 | 0.02 | 0.09 | 0.05 | 0.25 | 0.01 |
| Light-sensitive Layer | (negative-working type one) | | | | | |
| Printing Durability (No. of sheets) | $1 \times 10^5$ | $1 \times 10^5$ | $1 \times 10^5$ | $1 \times 10^5$ | $6 \times 10^4$ | $8 \times 10^4$ |
| Resistance to Background Contamination | good | fair | good | good | good | bad |
| Presence of Irregularity[2)] | YES | YES | YES | YES | NONE | NONE |

*Comparative Example.

[1)]The amount of aluminum removed through the etching treatment performed after the electrolytic surface-graining, expressed in g/m$^2$.

[2)]Presence or absence of irregularity of the order of not more than 0.1 μm within the pits formed during the electrolytic surface-graining treatment.

As seen from the results listed in Table I, when the substrate of the present invention was employed, lithographic printing plates having excellent printing durability and high resistance to background contamination of the non-image areas could certainly be obtained.

Likewise, lithographic printing plates were prepared using positive-working PS plates which comprise the substrate of the present invention provided thereon with a positive-working light-sensitive layer or the comparative substrate provided thereon with a positive-working light-sensitive layer and the resulting lithographic printing plates were investigated and compared to one another. As a result, it was found that the substrate of the present iNvention showed the balance between the background contamination/printing durability more excellent than that for the comparative substrate.

What is claimed is:

1. A method for manufacturing a substrate for presensitized plates for use in making lithographic printing plates comprising the steps of electrolytically surface-roughening an aluminum plate or an aluminum alloy plate in a nitric acid-containing electrolyte and then etching the surface with an alkali or an acid to thus form irregularity in the order of not more than 0.1 μm within pits formed on the plate surface during the electrolytic surface-roughening treatment.

2. The method of claim 1 wherein the etching is performed with at least one of sulfuric acid, persulfuric acid, hydrofluoric acid, nitric acid, hydrochloric acid, sodium hydroxide, potassium hydroxide, sodium tertiary phosphate, potassium tertiary phosphate, sodium aluminate, sodium silicate and sodium carbonate.

3. The method of claim 1 wherein the etching is performed with an alkali.

4. The method of claim 1 wherein the amount of aluminum or aluminum alloy removed through the etching treatment except for that of smut formed on the plate surface during the electrolytic surface roughening treatment ranges from 0.02 to 0.2 g/m$^2$.

5. The method of claim 4 wherein the amount of aluminum or aluminum alloy removed through the etching treatment except for that of smut formed on the plate surface during the electrolytic surface-roughening treatment ranges from 0.02 to 0.09 g/m$^2$.

6. The method of claim 1 wherein an alternating waved current power supply is used as a power supply for the electrolytic surface-roughening treatment.

7. The method of claim 6 wherein the alternating waved current power supply is selected from the group consisting of sinusoidal single-phase alternating currents, sinusoidal three-phase alternating currents, rectangular waved currents and trapezoidal waved currents.

8. The method of claim 7 wherein the alternating waved current power supply is a rectangular waved alternating current.

9. The method of claim 1 wherein the concentration of nitric acid in the electrolyte ranges from about 0.5 to 5% by weight.

10. The method of claim 9 wherein the nitric acid-containing electrolyte further comprises a corrosion inhibiting agent or a stabilizer selected from the group consisting of nitrates, monoamines, diamines, aldehydes, phosphoric acid, chromic acid, boric acid, ammonium salts, aluminum salts and carbonates.

11. The method of claim 1 wherein the electrolytic surface-roughening treatment is performed by a method which comprises passing, through the aluminum or aluminum alloy plate in a nitric acid-containing electrolyte, an alternating current at an electric voltage in which the anodic voltage is higher than the cathodic voltage so that the quantity of anode time electricity is higher than the quantity of cathode time electricity; or a method in which an apparatus for electrolytically surface-roughening is employed, the apparatus comprising a first circuit connected to a principal counter electrode against the aluminum plate, a second circuit for an auxiliary counter electrode connected, in parallel relation, to the first circuit and a diode or a mechanism serving as a diode for controlling the anode current passing through the principal counter electrode, which is fitted to the second circuit for the auxiliary counter electrode.

12. The method of claim 1 wherein the electrolytic surface-roughening treatment is performed at an electric voltage applied to the aluminum plate ranging from about 1 V to about 50 V; a current density ranging from about 10 $A/dm^2$ to about 100 $A/dm^2$, a quantity of electricity ranging from about 100 $coulomb/dm^2$ to about 30,000 $coulomb/dm^2$ and a temperature of the electrolytic bath ranging from about 10° C. to about 70° C.

13. The method of claim 12 wherein the electrolytic surface-roughening treatment is performed at an electric voltage applied to the aluminum plate ranging from 2 to 30 V; a current density ranging from 10 to 80 $A/dm^2$, a quantity of electricity ranging from 100 to 18,000 $coulomb/dm^2$ and a temperature of the electrolytic bath ranging from 20° to 60° C.

14. The method of claim 1 wherein the aluminum or aluminum alloy plate is degreased with a solvent, a surfactant or sodium silicate prior to the electrolytic surface-roughening treatment.

15. The method of claim 1 wherein the aluminum or aluminum alloy plate is etched with an alkali to expose the clean surface of the aluminum plate.

16. The method of claim 1 wherein the aluminum or aluminum alloy plate is anodized after the etching treatment.

17. The method of claim 16 wherein the anodization of the aluminum or aluminum alloy plate is performed at an electrolyte concentration ranging from 1 to 80% by weight, a temperature ranging from 5° to 70° C. and a current density ranging from 0.5 to 60 $A/dm^2$ so that the amount of the anodized layer ranging from 0.3 to 6 $g/m^2$ is formed.

18. The method of claim 1 wherein the aluminum or aluminum alloy plate anodized is further subjected to at least one of a hydrophilization treatment; application of an underlying layer of a hydrophilic cellulose containing a water-soluble metal salt, a polymeric compound composed of monomer units carrying a sulfonic acid group or a compound carrying $NH_4$ group•COOH group•$SO_3H$; and a treatment with a polyvinyl sulfonic acid.

19. A presensitized lithographic plate comprising a lithographically suitable light-sensitive layer provided on the support prepared by the method of claim 1.

20. The presensitized lithographic plate of claim 19, wherein the lithographically suitable light-sensitive layer comprises a light-sensitive diazo resin and a water-insoluble and lipophilic polymeric compound carrying hydroxyl groups.

* * * * *